United States Patent [19]

Ostreng

[11] Patent Number: 4,483,248

[45] Date of Patent: Nov. 20, 1984

[54] ALUMINUM/STEEL CAN SEPARATOR AND BALER

[76] Inventor: Arlen J. Ostreng, 1551 Miller Dr., LaCrosse, Wis. 54601

[21] Appl. No.: 481,749

[22] Filed: Apr. 4, 1983

[51] Int. Cl.[3] ..... B30B 9/32

[52] U.S. Cl. ..... 100/99; 100/91; 100/100; 100/125; 100/215; 100/250; 100/255; 100/256; 100/295; 100/902

[58] Field of Search ..... 100/91, 902, 100, 116, 100/125, 246, 247, 250, 52, 256, 99, 45, 215, 218, 255, 295

[56] References Cited

U.S. PATENT DOCUMENTS

| | | | |
|---|---|---|---|
| 917,754 | 4/1909 | Cumpston | 100/45 |
| 1,126,073 | 1/1915 | Peterson | 100/218 X |
| 2,059,229 | 11/1936 | Gregg | 100/91 |
| 2,616,477 | 11/1952 | Scheer | 100/902 X |
| 2,700,333 | 1/1955 | Polsen | 100/902 X |
| 3,412,837 | 11/1968 | Myers | 100/902 X |
| 3,537,390 | 11/1970 | Hinkel | 100/99 X |
| 3,785,278 | 1/1974 | Hopkins | 100/91 X |
| 4,073,228 | 2/1978 | Henzl | 100/99 X |
| 4,119,024 | 10/1978 | White | 100/902 X |
| 4,285,426 | 8/1981 | Cahill | 100/902 X |

FOREIGN PATENT DOCUMENTS

| | | | |
|---|---|---|---|
| 421060 | 8/1946 | Italy | 100/246 |

*Primary Examiner*—Billy J. Wilhite

*Attorney, Agent, or Firm*—Williamson, Bains, Moore & Hansen

[57] ABSTRACT

The recycling machine is provided with a baling chamber having a cyclable hydraulic ram. The ram cycles continuously, and each time it retracts, no more than a predetermined number of cans are admitted to the baling chamber for crushing and adding to the bale therein. A counting mechanism is provided as well as a mechanism for separating steel cans before baling.

10 Claims, 6 Drawing Figures

10
12
114
18
16
118
108a
36
38
112
108
134
136
40
32
6
132
102
106
120
58
30
110
130
66
132
60
72
44
116
62
104
64
54
52
6
52
68
54
50
70
48
24
122
78
124
126
80
84
84
82
82
128
86
26
28
90
26
28
26
88

22
92
78
80
84a
98
90
90
28
84
100
88

74
46
44
42
32
72
30
34
70
16
56
50
48

ALUMINUM/STEEL CAN SEPARATOR AND BALER

BACKGROUND OF THE INVENTION

In recent years, the recycling of aluminum cans has become a very desirable activity. Towards this end, a number of machines have been developed which typically count the cans and crush them with rollers or wheels and thence deposit the crushed cans in a container for later transport. One problem with these machines is that this method, wherein loose cans are deposited in a container, results in a fairly inefficient use of space requiring frequent emptying of the containers and, indeed, the transport of some kind of container for the loose cans between the collection point and the recycling point. Of course it is also desirable to remove steel cans from the aluminum cans initially as they are not as valuable. The aluminum/steel separation, typically by means of a magnet, is in general well known.

It is the object of this invention to provide a device which stores as many cans as possible in as limited a space as possible as well as not requiring the use of separate containers or other devices for the transport of the cans. It is further an object of this invention to provide a device which has fairly low power requirements so that it can be located and run out of a conventional outlet and wherein the whole device is small enough to be easily transported if desired. It is further an object of this invention to provide a device which allows one person to easily unload and transport the collective cans and which requires little or no direct supervision during its use. It is further, of course, desirable to be able to count and otherwise keep track of the number or cans a customer deposits in the machine.

SUMMARY OF THE INVENTION

A baling chamber is provided having a side door, the chamber tapering outwardly as it approaches the door so that the bale may be easily removed. The floor of the baling chamber drops slightly as the door of the chamber is opened, thereby allowing the bale to be easily removed with a dolly or the like. The floor is wedged into position by the door when it is shut thereby assuring that the floor is in proper position for continued operation later. A chute is provided which leads downwardly from the outside of the machine into the top of the baling chamber. The chute is sized so as to generally allow only one can at a time to pass through the chute. That is, the cans enter the chamber in a generally single file formation. As the cans pass down the chute, initially those cans are subjected to a rotating magnetic drum which picks steel cans out of the chute and deposits them down a separate chute which leads to a steel can storage chamber. The steel cans may thence be removed from the storage chamber and recycled separately. It is envisioned that if desired, a separate counting unit may be provided for the steel cans. Downstream from the steel separating drum is a counting unit which is located substantially above the chute by means of the provision of a light source which shines downwardly on a mirror located beneath the chute and which thence bounces upwardly to a detector located adjacent the light source. The detector then counts cans which pass down through the chute and which interrupt the light beam thereby providing an accurate count of cans passing therethrough.

After counting, the cans are deposited into the baling chamber. The hydraulic ram is designed to cycle continuously up and down. The provision of this continuously cycling ram allows the use of a much smaller hydraulic system than otherwise would be required if a large number of cans was to be compressed at one point. An extension on one side of the ram shuts off the chute as the ram comes downwards and due to the limited capacity of the chute, allows only no more than a predetermined number of cans to fall into the baling chamber and to be crushed at one time. As the ram then cycles upwardly again, another predetermined number of cans is admitted and the process repeated. The ram is designed to cycle upwardly and downwardly by means of attainment of a predetermined pressure in the hydraulic lines, attainment of that pressure prompting reversal of the ram action. A detector is located adjacent the one side of the ram which closes off the chute. This detector shows whether the ram is operating or not, as during normal crushing operation, the detector will cause an indicator light to blink on and off. In the event of the chamber being full, the detector will be continuously obstructed and thence, no blinking of the indicator light will take place thereby indicating the fullness of the chamber. This simple detector system also serves as a warning for any possible malfunction of the device if it does not continue to blink.

Since all compacting is done in the chamber, fluid left over in the cans may accumulate, and towards this end, drain holes are provided in the floor of the chamber along with a drip pan located therebeneath which may be emptied as necessary.

Provision is also made to shut off the baler only in the full up position. This is done by double wiring the hydraulic system so that even if the switch on the front is shut off, the baler will continue its cycle until it has reached its retracted or upward position.

These and other objects and advantages of the invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
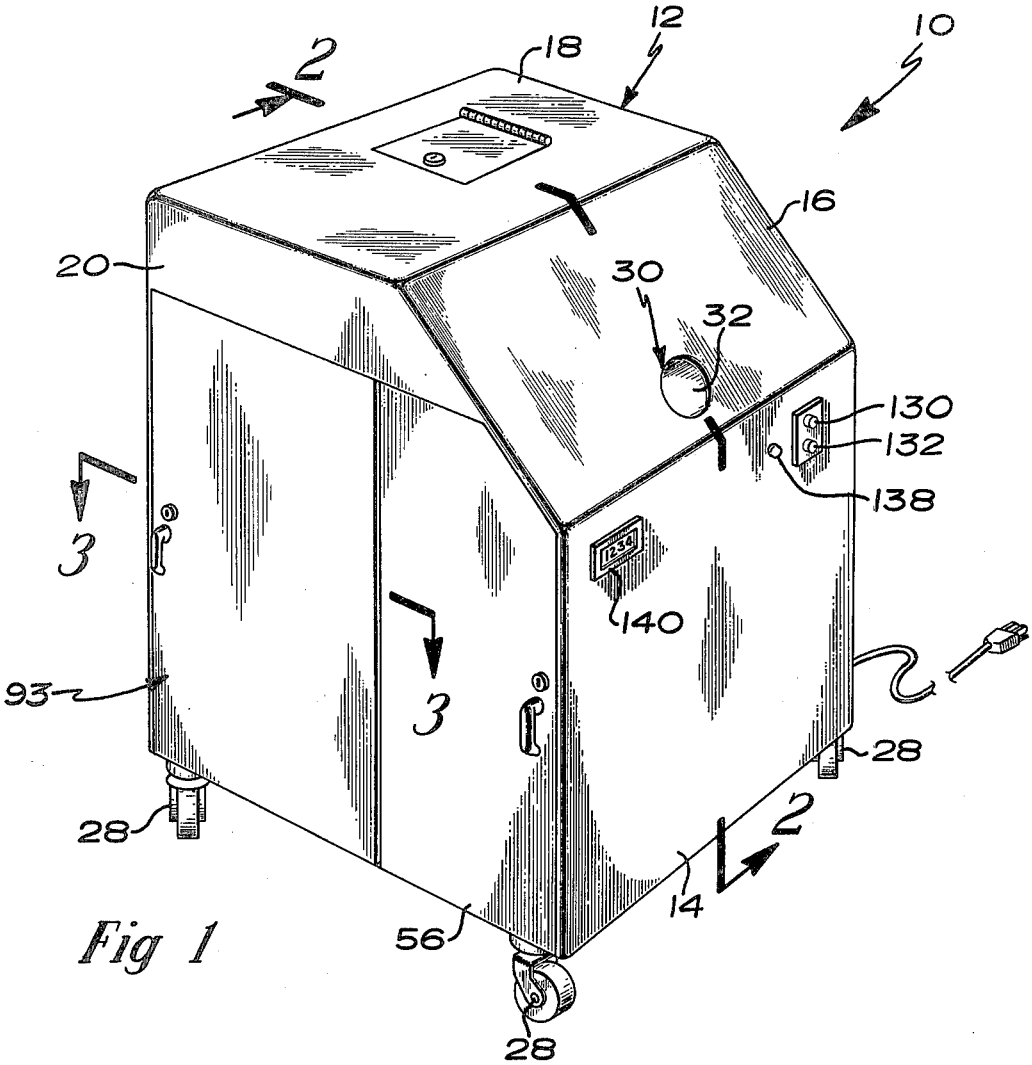
FIG. 1 is a perspective view of the recycling machine.

The recycling machine of the instant invention, 10, is housed in a cabinet designated 12. The cabinet 12 shows in perspective in FIG. 1 and comprises generally a front wall 14, an angled chute wall 16 and a top 18. Sides 20 and 22 are connected by a rear wall 24. Inside cabinet 12 is generally frame 26 preferably formed of rectangular tubing. Floor casters 28 are located on the bottom of machine 10 and in combination with its size enable the machine to be easily moved from one place to another through standard-sized doors to desirable collection points such as grocery stores and the like.

Figure 2:
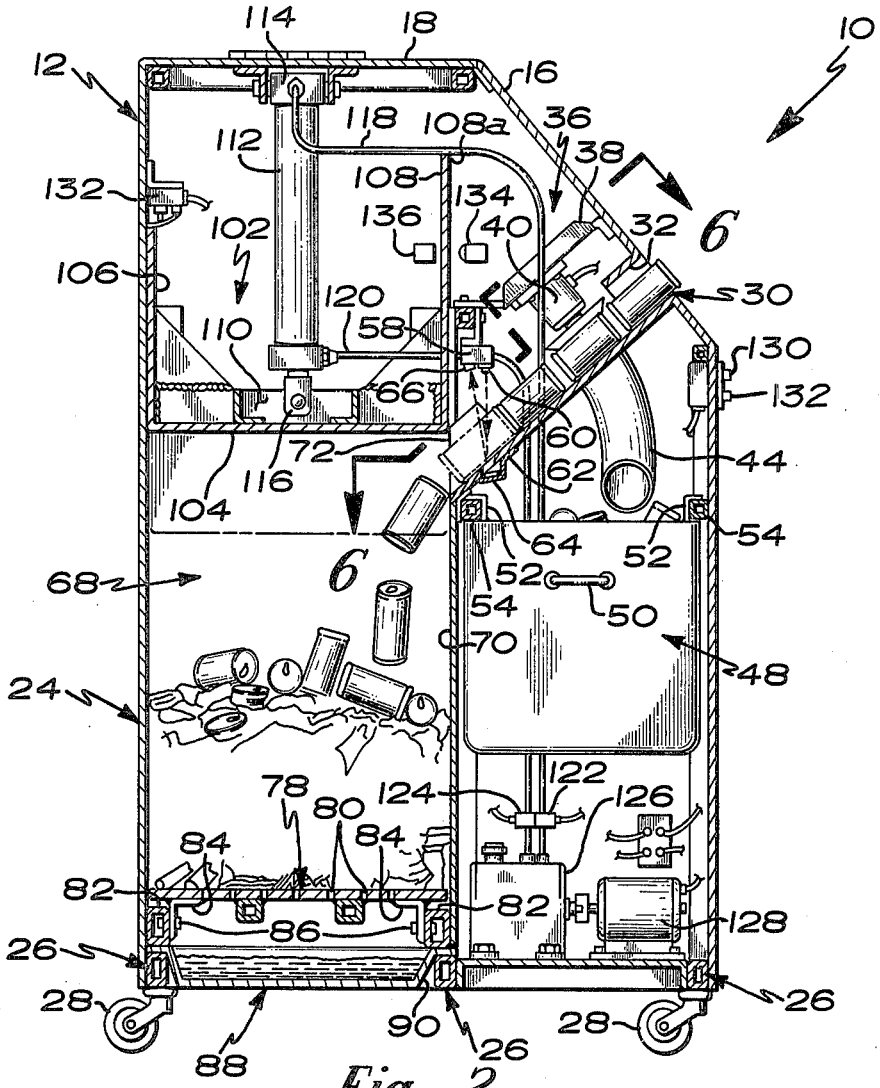
FIG. 2 is a sectional view taken along line 2—2 of FIG. 1.
Figure 6:
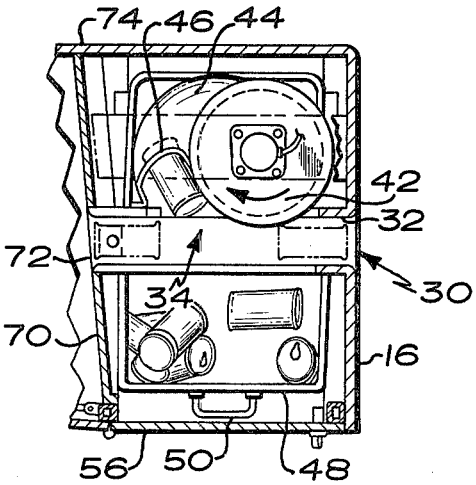
FIG. 6 is a sectional view taken along line 6—6 of FIG. 2.

The chute opening 32 is located in chute wall 16 and leads to chute 32. An opening 34 is located in the side of chute 32, opening 34 being provided for the separation of steel cans from the desired aluminum cans. Located in opening 34 is a steel can separator 36. Separator 36 is comprised of a mounting bracket 38 (shown in FIG. 2) upon which is mounted a motor 40 which in turn rotates a magnetized drum 42 which intrudes through opening 34. Magnetized drum 42 attracts steel cans in its chute 32 and deposits them in steel can delivery tube 44. A pick-off edge 46 shown particularly in FIG. 6, separates the steel cans from rotating drum 42 and allows the steel cans to fall downwardly through delivery tube 44 into steel can collection bin 48. Bin 48 is provided with a handle 50 and sliding flanges 52 which in turn slidably mount bin 48 on rails 54 as shown in FIG. 2. An access door 56 is provided in side 20 of cabinet 12 for access to bin 48 as well as the other mechanical components of the machine.

Continuing down chute 32 (shown best in FIG. 2), a detector unit 58 is located above chute 32. Detector unit 58 is comprised of a light source 60 which emits a beam of light which passes downwardly across the path of chute 32 and through a window 62 located in the bottom of chute 32. After passing through window 62, the light beam bounces off mirror 64 and upwardly to photocell detector 66 located adjacent light source 60. The provision of the detector unit 58 above chute 32 allows accurate counting as the detector unit 58 is not exposed to an appreciable amount of moisture from dripping cans as it would if the unit were mounted beneath chute 32. Conventional circuitry is attached to detector unit 58 for counting the pulses therefrom and thus, counting the aluminum cans deposited in the machine 10.

Figure 3:
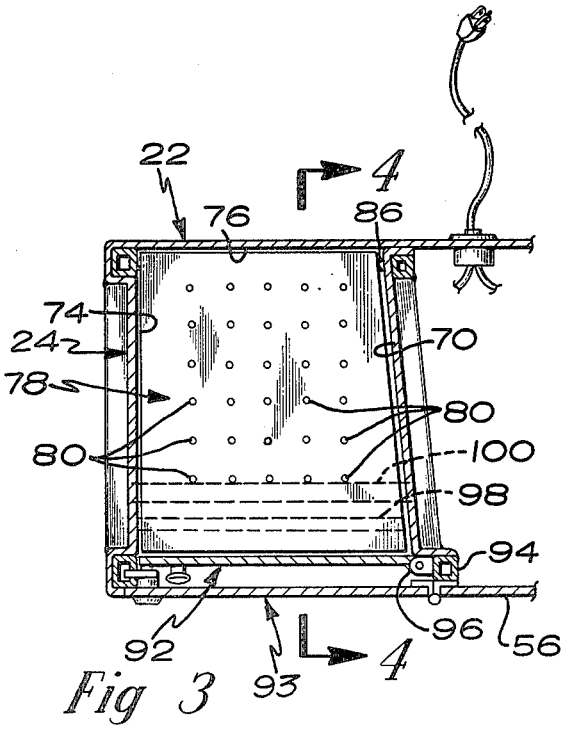
FIG. 3 is a sectional view taken along line 3—3 of FIG. 1.
Figure 4:
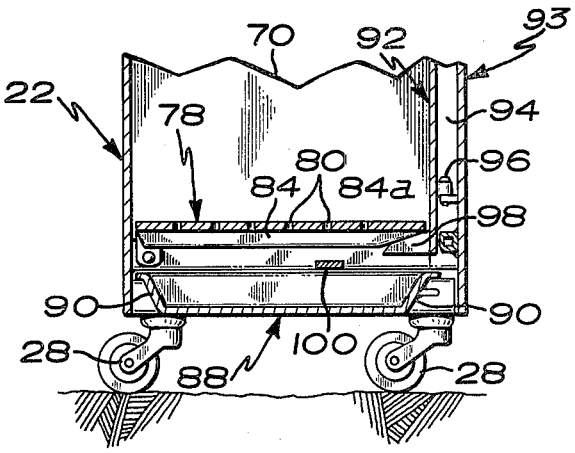
FIG. 4 is a sectional view taken along line 4—4 of FIG. 3.
Figure 5:
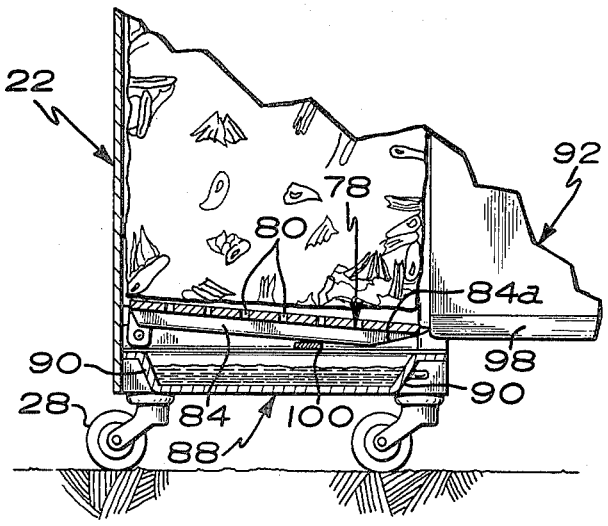
FIG. 5 is a view similar to FIG. 4 showing the baling chamber door open and the floor lowered.

After passing detector unit 58, chute 32 opens into baling chamber 68. In particular, baling chamber side wall 70 is provided with a delivery opening 72 which terminates chute 32. Chamber 68 has a second side wall 74 as shown particularly in FIG. 3, as well as a rear wall 76 and a floor 78. Floor 78 is provided with a number of drain holes 80 which allow for the drainage of excess liquid remaining in the cans during the crushing and baling operation. As can be seen in FIG. 3, first and second side walls 70 and 74 respectively, are not parallel to one another and in fact, diverge outwardly from one another as they approach chamber door 92. This divergence allows the bale to be easily removed from chamber 68 when necessary. Floor 78 is provided with angle iron reinforcing 84 along the two sides thereof. Floor 78 is hinged by means of hinges 86 to frame rails 82 as shown in FIGS. 2, 4 and 5. A drain pan 88 is located beneath floor 78 and has flanges 90 thereon which are located beneath frame members 26 and 82. Thus, drain pan 88 may be slidably removed for emptying when full. As seen in FIG. 3, chamber access door 92 is hinged to vertical frame member 94 by means of hinge 96. Located at the bottom of door 92 is a wedge member 98 which engages the front end of floor reinforcement 84 which has a wedge area **84*a* thereon. When door 92 is opened, floor 78 drops downwardly as shown in FIG. 5 whereupon a dolly may be easily inserted beneath the bale therein for quick and easy removal. A stop 100 limits the downward travel of floor 78 as shown in FIG. 5. An outer cabinet door 93 is also provided to prevent chamber door 92** from being opened inadvertently.

The crushing mechanism 102 is best shown in FIG. 2 and is comprised of a ram plate 104 which contacts and crushes the top surface of the material to be baled. Ram plate 104 has side walls 106 and 108, the latter of which has a top edge **108*a*, the purpose of which will be more fully explained hereinafter. Ram plate 104 has a frame member 110 to which is attached to double acting hydraulic cylinder 112 having an upper end 114 and a bottom end 116. Hydraulic lines 118 and 120 are attached to about the top 114 and bottom 116 of cylinder 112, respectively. Lines 118 and 120 are provided with hydraulic limit switches 122 and 124. Upon the reaching of a pressure in lines 118 and 120 of approximately 1850 psi, switches 122 and/or 124 will trip, thence prompting pump 126 to reverse. Pump 126 is driven by means of motor 128. The cylinder is sized to provide a crushing, downward force of approximately nine tons. This amount of crushing force enables the unit to be operated with a fairly small motor 128 and pump 26** which may be powered off a conventional 120 volt line so that the machine can be placed in locations which do not have special power outlets.

A simple on-off switch 130 is provided on front panel 14 and is connected to motor 128. Motor 128 is also double wired to switch 132. It is desired that the ram plate 104 always be in the upward-most position when the machine stops and hence, the top edge of side wall 106 is arranged to contact switch 132 at its upward limit of travel. Accordingly, because of the double wiring, if switch 130 is turned off in mid-cycle, cylinder 112 will continue to cycle until ram side wall 106 contacts switch 132 whereupon the mechanism will shut down with the ram plate 104 in its retracted or upper position. This insures that the bale is easily removable from chamber 68.

Also shown in FIG. 2, a light source 134 is provided on one side of ram side wall 108 while a light detector 136 is provided on the other side. Light source 134 and detector 136 are positioned so as to be at the level at which the top edge **108*a* of side wall 108 will be when ram plate 104 is downwardly extended in a full chamber (as shown by the dotted line in FIG. 2). Detector 136 is connected to an indicator light 138 on front panel 14. During normal operation, light 138 will blink on and off as top edge 108*a* passes between light source 134 and detector 136. When chamber 68 is full, side wall 108 will continually obstruct the light from detector 136 and hence, light 138 will remain constantly on (or off, depending on the wiring). The stopping of the blinking action of light 38 signals the operator or monitor that chamber 68 is full (or that there is a malfunction). Also located in front wall 14 is a counter 140 which is preferably easily resettable. If it is desired, provision may be made for remote mounting of light 138 and counter 140 in an office area so that the number of cans inserted by a customer may be monitored for payment purposes. Also, the remote location of light 138** allows the remote monitoring of the proper operation of the machine as well as the indication that the machine is full.

In operation, cans are inserted into opening 30. As the cans pass steel can opening 34, any steel cans are picked off by the rotating drum and slide down chute 44 into steel can bin 48. The aluminum cans continue downwardly through chute 32 past detector unit 58 which counts the cans and displays the count on counter 140. As can be seen in FIG. 2, chute 32 is of a fairly limited capacity and thus, only a limited number of cans can be accommodated therein at one time. Normally, ram plate 104 cycles continually upwardly and downwardly. Each time plate 104 reaches its upward position as shown in FIG. 2, the cans located in chute 32 are allowed to enter baling chamber 38 through delivery opening 72. As hydraulic cylinder 112 reverses and forces ram 104 downwardly, ram side wall 108 closes off the delivery opening 72 and thus, ram 104 need crush only a limited number of cans. This provision which crushes a limited number of cans for each cycle of ram plate 104 allows the use of a small unit so that the whole machine 10 is easily portable and operable on 120 volts.

While the preferred embodiments of the present invention have been described, it should be understood that various changes, adaptions and modifications may be made therein without departing from the spirit of the invention and the scope of the appended claims.

What is claimed is:

1. A can recycling machine comprising:

a baling chamber, said baling chamber comprising:

a floor wherein said floor is movable between a first position for compacting cans in said chamber and a second position wherein said floor is below said floor when said floor is in said first position so that removal means may be inserted between a bale and said floor when said floor is in said second position;

an access door;

wedge means associated with said door for maintaining said floor in said first position when said door is closed;

first and second walls adjacent said door, said first and second walls diverging from one another as said walls approach said door;

means for continuously cyclically compacting cans in said chamber; and means for admitting no more than a predetermined number of cans into said chamber for each cycle of said compacting means.

2. The can recycling machine of claim 1 further comprising a chute leading into said chamber.

3. The can recycling machine of claim 2 further comprising means for removing steel cans from said chute.

4. The can recycling machine of claim 3 further comprising means for counting cans in said chute, said counting means being located between said chamber and said steel can removing means.

5. The can recycling machine of claim 4 wherein said counting means is located above said chute.

6. The can recycling machine of claim 2 wherein said compacting means comprises a ram, said admitting means comprising a portion of said ram which cyclically occludes said chute as said ram cycles.

7. The can recycling machine of claim 1 further comprising means for indicating the cycling of said compacting means.

8. The can recycling machine of claim 1 wherein said compacting means cycles between an uppermost position and a position at which a maximum predetermined crushing pressure is reached.

9. The can recycling machine of claim 8 further comprising switching means associated with said compacting means for switching said compacting means between operative and inoperative conditions, said switching means being capable of said inoperative condition only when said compacting means is in said uppermost condition.

10. A can recycling machine comprising:

a baling chamber, said baling chamber comprising a floor, an access door and first and second walls adjacent said door, wherein said floor is movable between a first position for compacting cans in said chamber and a second position wherein said floor is below said floor when said floor is in said first position so that removal means may be inserted between a bale and said floor when said floor is in said second position and wherein said first and second walls diverge from one another as said walls approach said door;

wedge means associated with said door for maintaining said floor in said first position when said door is closed;

means for continuously cyclically compacting cans in said chamber; and means for admitting no more than a predetermined number of cans into said chamber for each cycle of said compacting means.

* * * * *